United States Patent [19]

Schroeder

[11] 4,226,698

[45] Oct. 7, 1980

[54] ASH REMOVAL AND SYNTHESIS GAS GENERATION FROM HEAVY OILS PRODUCED BY COAL HYDROGENATION

[76] Inventor: Wilburn C. Schroeder, 7316 Radcliffe Dr., College Park, Md. 20740

[21] Appl. No.: 931,286

[22] Filed: Aug. 4, 1978

[51] Int. Cl.[3] ..... C10G 1/00

[52] U.S. Cl. ..... 208/8 R

[58] Field of Search ..... 208/8 R

[56] References Cited

U.S. PATENT DOCUMENTS

| | | | |
|---|---|---|---|
| 1,970,248 | 8/1934 | Pier et al. | 208/8 R X |
| 2,655,443 | 10/1953 | Moore | 48/63 X |
| 2,971,830 | 2/1961 | Kawai et al. | 48/123 X |
| 3,639,261 | 2/1972 | Slater | 48/196 |
| 3,692,506 | 9/1972 | Johnson | 48/210 |
| 3,715,301 | 2/1973 | Tassoney et al. | 208/8 R |
| 3,729,407 | 4/1973 | Camp et al. | 208/10 |
| 3,884,794 | 5/1975 | Bull et al. | 208/8 |
| 3,926,775 | 12/1975 | Schroeder | 208/8 R X |
| 3,962,070 | 6/1976 | Stotler | 208/10 |
| 4,066,420 | 1/1978 | Danguillier et al. | 48/197 R |
| 4,074,981 | 2/1978 | Slater | 48/197 R |
| 4,097,360 | 6/1978 | Sack | 208/8 R |

FOREIGN PATENT DOCUMENTS 1116979 6/1968 United Kingdom .

*Primary Examiner*—Delbert E. Gantz
*Assistant Examiner*—William G. Wright
*Attorney, Agent, or Firm*—Bacon & Thomas

[57] ABSTRACT

Coal hydrogenation processes which produce a residual fraction containing carbonaceous material and ash as well as the desired hydrocarbon product fractions are improved by introducing the residual fraction into an oxidation reactor operating under tangential gas velocities and at a temperature in excess of that of the fusion temperature of the ash. Molten ash drips from the side walls of the reactor and hot hydrogen containing gases are generated for use in the hydrogenation process.

7 Claims, 1 Drawing Figure

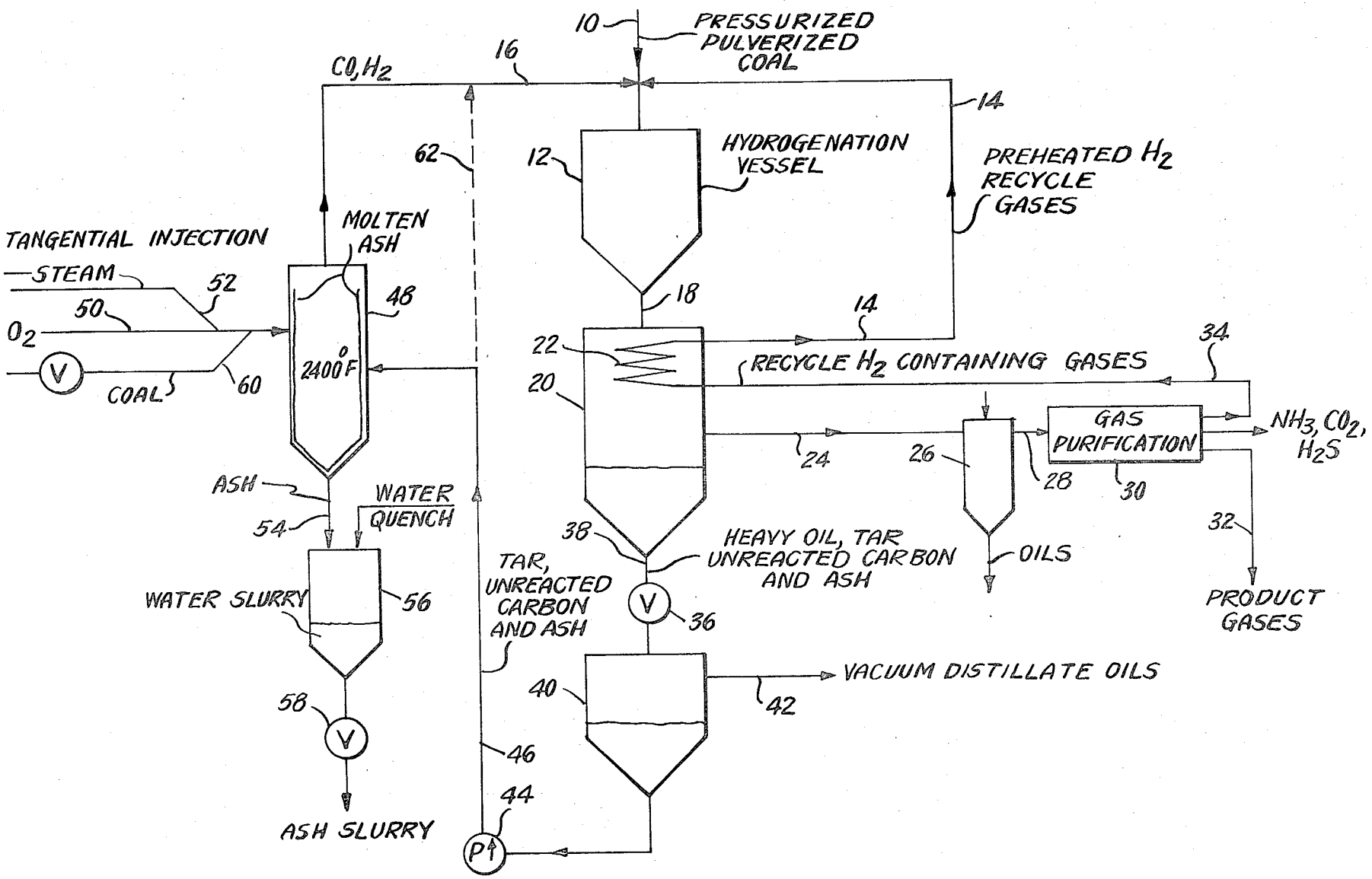
PRESSURIZED PULVERIZED COAL
10
HYDROGENATION VESSEL
12
PREHEATED $H_2$ RECYCLE GASES
14
16
18
RECYCLE $H_2$ CONTAINING GASES
22
20
24
34
GAS PURIFICATION
30
28
$NH_3$, $CO_2$, $H_2S$
PRODUCT GASES
32
OILS
26
HEAVY OIL, TAR UNREACTED CARBON AND ASH
38
36
VACUUM DISTILLATE OILS
42
40
TAR, UNREACTED CARBON AND ASH
46
44
P
62
CO, $H_2$
MOLTEN ASH
48
2400°F
WATER QUENCH
56
ASH
54
WATER SLURRY
58
ASH SLURRY
TANGENTIAL INJECTION
STEAM
52
50
$O_2$
60
COAL

ASH REMOVAL AND SYNTHESIS GAS GENERATION FROM HEAVY OILS PRODUCED BY COAL HYDROGENATION

BACKGROUND OF THE INVENTION

The utilization of ash-containing carbonaceous residues and removal of ash from the system has long been a problem in coal hydrogenation processes. For example, coal hydrogenation processes, in which coal is fed to the hydrogenation reactor in the absence of a pasting oil, produce gases, light oils, heavy oils, and tars. The light oils can be removed from the heavy oils and tars by vaporization or flesh evaporation and are thereby essentially freed of ash or other constituents such as tar or carbon. The remaining heavy oil-tar phase then contains the ash from the coal as well as unreacted coal or carbon particles.

In numerous hydrogenation processes attempts have been made to free the heavy oil-tar from solid matter by filtering or centrifuging. This has been found to be exceedingly difficult and very slow, requiring a great deal of equipment, resulting in a costly operation. In general these methods are regarded as highly unsatisfactory for the production of large volumes of liquid fuels from coal such as may be required in plants producing in excess of 50,000 barrels per day, as is presently contemplated.

One method for eliminating the heavy oil-solids separation step is to vaporize the light oil from the heavy oil in the hydrogenation process and then to continue the hydrogenation of the heavy oil-tar until it also becomes a distillable product. The light oil must be separated from the heavy oil and removed from the hydrogenation zone before further hydrogenation of the heavy oil-tar is undertaken, or much of the light oil will be hydrogenated to hydrocarbon gases. The velocity of the hydrogen-containing gases through the heavy oil hydrogenation zone will carry both the distillable oils which are formed, as well as ash and other solid, out of this zone. Since the ash and unreacted carbon are now in a gas phase, the solids may be removed from the gas in a cyclone separator. This method of separating the solids from oil vapors is shown in U.S. Pat. No. 3,926,775 (Dec. 16, 1975, by W. C. Schroeder).

It should be noted, however, that this method of solids removal cannot be used in hydrogenation processes in which the coal is fed to the processes as a slurry of oil and coal, since in essence it eliminates most or all of the heavy oil required in a slurry process. It is evident, therefore, that this method of ash removal is applicable only to hydrogenation processes in which coal is fed as a pulverized solid, as is the case in U.S. Pat. No. 3,926,775.

A catalytic process for the hydrogenation of coal has been proposed in which the residual materials are in the form of solid char containing the catalyst. This material is fed into a partial oxidation reactor where CO and $H_2$ are generated and catalyst is said to be vaporized. The exit gases from the vaporizer are fed to the hydrogenator and ash is removed from the bottom of the reactor. U.S. Pat. No. 3,729,409 (Apr. 24, 1973 to Camp et al).

SUMMARY OF THE INVENTION

The present invention provides a simple, versatile and improved process for the separation of ash from coal hydrogenation residues and for the use of the residual material to supply hydrogen-containing gases for the hydrogenation process. In particular, it provides a process for more effective removal of ash and generation of hydrogen-containing gases in a partial oxidation reactor to which the residues are fed. One method by which this is accomplished is to improve the mechanical design of the partial oxidation reactor to secure a better ash separation as will be shown.

In a preferred embodiment of the invention, the hydrogenation process produces an effluent stream containing a gaseous component, distillable oils, heavy oils and tars, unreacted coal, carbon and ash. The gases and distillable oils are separated from this effluent to leave a pumpable residue containing the heavy oils and tars, unreacted coal, carbon and ash. This residue is pumped to a partial oxidation reactor which is operated at a temperature above the fusion temperature of the ash of the residue and with a tangential gas velocity which will throw the molten particles of ash to the side walls of the reactor where they drip to the reactor bottom and can be withdrawn in molten form. Steam and oxygen may be tangentially introduced into the reactor to provide the tangential gas velocity and the gas velocity is quite high. Rapid reaction at the high temperatures of the reactor and high gas velocity is accomplished.

DETAILED DESCRIPTION

The invention will now be further described in conjunction with the accompanying flow sheet drawing. Referring now to the drawing, pulverized coal, in the absence of a pasting oil, is fed through line 10 to a pressurized coal hydrogenation reactor 12. Preheated hydrogen is fed to reactor 12 through line 14 and hot $H_2$ and CO containing gases are fed to the reactor through line 16. Suitable temperatures, pressures and times are maintained in reactor 12 to hydrogenate the coal to the desired products, which in the preferred embodiment will be a mixture of gases containing hydrocarbons, distillable oils, heavy oils and tars, unreacted coal and carbon, and finally the ash from the coal. Temperatures in the range of from about 750° F. to 1250° F. and pressures in the range of from about 1000 to 5000 psi are usually employed.

All materials from the hydrogenation reactor 12 are discharged through line 18 into vessel 20. Here they pass over heat exchanger 22 which preferably is used to preheat the incoming recycle hydrogen-containing gases. This cools the effluent from reactor 12 below hydrogenation temperature and prevents further hydrogenation of the light liquid hydrocarbons to gases. The temperature of the products after passing over the heat exchanger 22 are in the order of 500°–750° F. The gases and vaporized hydrocarbons pass out through line 24 to a recovery system 26 which condenses the oils and removes them from the system as products. The gases leave the liquid recovery system 26 through line 28 and go to gas purifying unit 30 where they are purified to remove $CO_2$, $NH_3$ and $H_3S$. Methane and higher hydrocarbon gases may be withdrawn as a product through line 32. Remaining gases are recycled back to the hydrogenation process through line 34, heat exchanger 22 and line 14.

Vapors in vessel 20 are washed by heavy oil, tars and condensate from heat exchanger 22, and liquid accumulated at the bottom of this vessel contains not only oil and tars not volatile under these conditions, but also unreacted carbon and ash. This mixture, essentially free of gases, is let down in pressure through valve 36 in line 38 into vacuum vessel 40.

Under selected conditions in vacuum vessel 40 part of the feed from vessel 20 vaporizes and is removed overhead through line 42 as a distillate oil product. If desired vacuum vessel 40 may contain fractionating devices and be equipped externally with a system to provide reflux, thereby effecting fine separation of components between overhead distillate and bottoms product. Those skilled in the art may select conditions to provide the fractionation they desire. However, it is desirable that the bottoms from this vessel remain in pumpable form.

One purpose of the invention is to facilitate the removal of the ash from the mixture leaving the bottom of vessel 40, while at the same time using the heavy hydrocarbons, unreacted coal or carbon of this mixture to furnish $H_2$ and CO for the hydrogenation process. This insures that all carboneous matter obtained from the initial pulverized coal feed is completely converted to gases or liquids. This is done by pumping the mixture through slurry pump 44 and line 46 to partial oxidation reactor 48, where these materials are reacted with $O_2$ and steam introduced through lines 50 and 52 to produce synthesis gas consisting primarily of CO and $H_2$.

The feed to the partial oxidation reactor 48 may be adjusted somewhat by varying vacuum and/or reflux rates in vacuum vessel 40.

Operating conditions in the partial oxidation reactor 48 are critical in a number of respects. The first is that at temperatures appreciably below 2000° F., the reactions are slow, requiring long retention times and a very large vessel. A further factor is that even with long retention times at temperatures below 2000° F., the limited supply of oxygen may allow up to 50 or 60 percent of the carbon to pass through as unreacted carbon. It is therefore desirable to operate this reactor at temperatures above the fusion temperature of the ash in the coal, e.g., 2000°–3000° F., and generally in the range above 2400° F. It is also desirable to operate the partial oxidation reactor 48 at a pressure just above the pressure in the hydrogenation reactor 12 to avoid the necessity of cooling, compressing and reheating the make-up synthesis gas. Technology now available—not the subject of this patent—allows this to be accomplished.

A second problem solved by this invention is that of removing even very fine ash particles from the residual product of the coal hydrogenation process. For an Illinois coal the weight percent distribution of the ash, based on particle size of the ash in the liquid bottoms product, was found to be as follows:

| Particle size in microns | Approximate % of particles below size |
|---|---|
| 25 | 100 |
| 20 | 98 |
| 15 | 95 |
| 10 | 92 |
| 5 | 70 |
| 2 | 10 |

More than 90 percent of the ash was below 10 microns. Under these conditions, even with gas velocities below 0.1 foot per second, the ash would be carried overhead and out of the partial oxidation reactor with the gas.

To permit reasonable gas velocities (and in turn reasonable gasification rates as well as nearly complete carbon conversion) this invention comprises operation above the ash fusion temperature where the fine solid ash particles may be agglomerated into liquid drops of appreciable size and at the same time under gas flow conditions which will throw the liquid particles to the walls so the liquid can drip down and be removed from the bottom of the partial oxidation reactor. This is done by operating the partial oxidation reactor 48 with high tangential gas velocities. Reactor 48 is a cylindrical vessel.

Referring again to the drawing, the heavy oil, tar, unreacted carbon and ash are pumped through line 46 and are injected into the interior of partial oxidation reactor 48. Oxygen and steam (preheated if desired) are fed through the lines 50 and 52 and are injected tangentially into reactor 48 at velocities in excess of 5 feet per second, preferably in excess of 10 feet per second. The temperature in reactor 48 is controlled by the ratio of oxygen to steam fed to the system; higher oxygen ratios create higher temperatures in the partial oxidation reactor. However, in all cases the temperature is maintained well above the fusion temperature of the ash in the coal.

The liquid ash particles thrown to the walls of the partial oxidation reactor 48 drip down as molten ash to the bottom and are removed through line 54 into vessel 56, which contains water. The molten ash cools into a water-ash slurry and is removed from vessel 56 by a slurry discharge system 58.

The gas leaving the top of the partial oxidation reactor 48 through line 16 is mainly CO and $H_2$ with some excess steam and lesser amounts of $CO_2$ and other gases. Temperatures of recycle hydrogen (line 14), synthesis gas (line 16), and coal (line 10) are controlled to give the desired operating temperature in coal hydrogenation vessel 12. The small amount of very fine ash particles which may escape reactor 48 with the gases through line 16 are subsequently mixed with the incoming coal to be hydrogenated. They do not exert any deleterious effect on the hydrogenation process.

Depending on the coal used, conditions of hydrogenation, and products desired, the amount of heavy oil and tar produced may be too small or too large to supply the required make-up hydrogen for the hydrogenation process. If the supply of heavy oil and tar is insufficient, coal may be fed directly with these materials to the partial oxidation reactor. Feeding pulverized coal to the system is facilitated by the fact that coal may be fed from the pressurized coal feeder system (not shown) which is used for the hydrogenation process. Such feeder systems are well known in the art and accordingly, have not been illustrated. As an alternate procedure, a slurry of coal and water could also be pumped with the heavy oil and ash to the reactor.

If the supply of heavy oil and tar is greater than desired, it may be reduced by a further step of hydrogenating the heavy oil and tar or by recycling excess heavy oil and tar to the hydrogenation reactor 12 through line 62 to convert an additional amount to distillable oils.

The process of the present invention thus provides a highly efficient means for generating hydrocarbon oils and gases from coal. This efficiency stems from the fact that the carbonaceous matter derived from the coal fed to the process is virtually completely converted to gases or liquids. Indeed, the only way carbonaceous matter can escape from the system is by entrapment in the ash removed from the partial oxidation reactor. However, as this reaction operates at temperatures above the melting point of the ash, such entrapment would be very small.

A second highly significant advantage of the invention is that it substantially reduces the necessity of securing high conversions of carbonaceous matter in the hydrogenation vessel since any carbonaceous matter which passes through the hydrogenation vessel without being converted to oil or gas is utilized in the partial oxidation reactor to make $H_2$ and CO for the hydrogenation vessel. In other words, this cycle insures that essentially all of the carbonaceous matter from the coal feed is used in the process.

While the invention has now been described in terms of certain preferred embodiments, and exemplified with respect thereto, the skilled artisan will readily appreciate that various modifications, changes, omissions and substitutions may be made without departing from the spirit thereof. It is intended, therefore, that the present invention be limited solely by the scope of the following claims.

I claim:

1. A continuous process for the hydrogenation of coal, comprising introducing particulate coal to a hydrogenation zone, reacting the coal in said zone under hydrogenation conditions with hydrogen-containing gases to produce an effluent containing a gaseous component, distillable oils, heavy oils and tars, unreacted coal, carbon and ash, separating said gaseous component and vacuum distilling light oils from a pumpable residue containing said heavy oils and tars, unreacted coal, carbon and ash, introducing at least a portion of said pumpable residue into a partial oxidation reactor operating at a temperature above about 2400° F. to generate hot gases containing hydrogen and carbon monoxide and convert the ash to molten form, introducing said hot gases from the partial oxidation reactor into the hydrogenation zone to provide at least a portion of the hydrogen requirement for the hydrogenation reaction, and removing molten ash from said oxidation reactor.

2. The process as defined in claim 1, wherein the partial oxidation reactor has cylindrical walls and is operated under tangential gas velocities sufficient to cause molten ash particles to be thrown against said walls where it forms a molten ash stream which is collected at the bottom of the reactor and is removed therefrom.

3. The process of claim 1 or 2 in which a portion of the pumpable residue is returned to the coal hydrogenation zone for further hydrogenation along with added coal.

4. The process of claim 1 or 2 wherein the temperature in the hydrogenation zone is in the range of about 750° F. to 1250° F., the pressure in the hydrogenation zone is in the range of about 1000 to 5000 psi and the pressure in the partial oxidation reactor is in excess of that in the hydrogenation zone.

5. The process of claim 1, wherein the feed materials introduced into said continuous process consist essentially of coal, steam and oxygen and the only carbonaceous materials withdrawn from the process are in the form of distillable oils and gases, all other carbonaceous material from the hydrogenation zone being reused in the process thereby achieving essentially complete utilization of all carbon-containing material in the feed to the process.

6. The process as defined in claim 2, wherein pumpable residue, steam and oxygen are tangentially introduced into the partial oxidation reactor to provide said tangential gas velocity.

7. The process of claim 6 wherein the steam and oxygen are introduced at a gas velocity in excess of about 5 feet per second.

* * * * *